United States Patent [19]

Capasso et al.

[11] Patent Number: 4,638,866

[45] Date of Patent: Jan. 27, 1987

[54] FIRE-SPRINKLER CUT-OFF DEVICE

[75] Inventors: Vincent Capasso, Lansdale, Pa.; Charles W. Kalck, Sr., 635 Camp Wawa Rd., Lederach, Pa. 19450

[73] Assignees: Charles W. Kalck, Sr.; Kathy Kalck, both of Lederach, Pa.

[21] Appl. No.: 824,729

[22] Filed: Jan. 31, 1986

[51] Int. Cl.[4] ..... A62C 39/00

[52] U.S. Cl. ..... 169/90; 169/38

[58] Field of Search ..... 169/90, 37, 38, 41

[56] References Cited

U.S. PATENT DOCUMENTS

| | | | |
|---|---|---|---|
| 615,270 | 12/1898 | Grew | 169/37 |
| 2,520,588 | 8/1950 | Wells et al. | 169/90 |
| 3,223,171 | 12/1965 | De Groot et al. | 169/90 |
| 4,139,062 | 2/1979 | Rago | 169/37 |

*Primary Examiner*—Joseph F. Peters, Jr.
*Assistant Examiner*—Michael J. Forman
*Attorney, Agent, or Firm*—Eugene E. Renz, Jr.

[57] ABSTRACT

An apparatus for stopping the flow of water through the opening in a fire sprinkler head after the failure of an originally installed triggering device, which apparatus thereafter serves as a substitute triggering device. The apparatus is provided with a meltable body portion having a first bore formed therein with a shoulder formed at one end of the first bore and a second bore formed generally transverse to and in contact with the first bore at the shoulder end of the first bore, a spring positioned in the first bore, a piston positioned within the spring and having a slot at one end which is alignable with the second bore and a pin inserted through the second bore and engaging the piston slot. Thus, after placement in a sprinkler head, transverse movement of the pin results in the release of the piston which is moved by the spring into the sprinkler head opening, stopping the flow of water.

4 Claims, 7 Drawing Figures

FIRE-SPRINKLER CUT-OFF DEVICE

FIELD OF THE INVENTION

This invention generally relates to devices for stopping the flow of water through a sprinkler head in a fire-extinguishing sprinkler system typically located in the ceiling of a commercial building. More particularly, the present invention relates to a device for stopping the flow of water in a previously installed sprinkler system in which the original valves or triggering devices used to stop the flow of water have failed and require replacement.

BACKGROUND OF THE INVENTION

As is well known in the art, sprinkling or fire-extinguishing systems typically include a plumbing array installed or attached to the ceiling of each floor of a building and having a plurality of sprinkler heads extending therefrom. The sprinkler heads are usually disposed at fixed distances such that water passing through the heads will affectively cover all of the floor surface in the building. In order to prevent the flow of water from the sprinkler system until such time as a fire condition exists, and then only in that portion of the building where such fire condition exists, there has been developed a variety of triggering devices. Such triggering devices are typically positioned within the sprinkler head and include at least one component made from a fusible or meltable material. The fusible component serves to release plug components when heat is applied thereto, allowing for the flow of water. See, for example, U.S. Pat. Nos. 329,311; 615,270; 1,160,517; and 1,233,289.

A major drawback with systems of this type is that from time-to-time the triggering devices would fail. In the past, in order to repair a sprinkling system after the failure of a triggering device, the entire system needed to be shut down. Thereafter, the sprinkler head would typically be temporarily plugged by literally hammering a frusto-conical shaped wooden object into the head opening. The system would then be reactivated with the wooden plug preventing flow of water from the sprinkler head. In order to repair the damaged sprinkler head, the system would again be shut down while repair work took place. As can be appreciated, significant periods of time would pass in which the sprinkler system would be deactivated, assuming the sprinkler control valves can be located prior to the occurrence of water damage. The only alternative to completing repairs to the system would be to allow one or more sprinkler heads to remain inoperative.

In order to alleviate these problems, substitute plug devices were developed for insertion into a sprinkler head after a failure occurred. Wells et al U.S. Pat. No. 2,520,588 discloses one such shut-off device. The shut-off device is placed into a sprinkler head after a triggering device failure and allegedly operates to quickly seal the sprinkler opening. The problem with Wells et al is that once it has been properly placed into a sprinkler head, the system must still be shut down and repaired in a manner virtually identical to the wooden-stake shut-off. In other words, a Wells et al shut-off does not provide a complete solution to the problem.

Similarly, DeGroot et al U.S. Pat. No. 3,223,171 is another attempt at solving the problems associated with the wooden-stake cut-off procedure. That patent discloses two telescoping members containing a compressed spring as being held together by a single pin. Axial removal of the pin allows the spring to force the telescoping members to extend, which, in turn, forces a resilient member over the opening in the sprinkling head. However, after the DeGroot et al device has been installed, no provision is made for thereafter triggering the sprinkler system in case of a fire. Consequently, the entire system must again be shut down so that the DeGroot et al device can be removed and replaced with a heat-sensitive triggering device. DeGroot et al possesses yet another problem not encountered with the Wells et al shut-off device. In order to stop the flow of water in a sprinkler head, pressure of at least 100 psi must be exerted against the sprinkler head opening. Consequently, the spring which is compressed between the telescoping members of the DeGroot et al device must be capable of providing sufficient pressure against the resilient member. It has been discovered that the force required to compress such a spring between the two telescoping members also provides for a significant amount of friction when the telescoping members are held together by a single pin requires axial movement for removal. This friction has been determined to be so great that it would take a significant amount of time, if it could even be accomplished at all, to remove the pin while exerting great force. It is believed that the time and the force required to remove the pin would result in the occurrence of unwanted water damage.

It is yet a further object of the invention to provide a sprinkler head cut-off device which can be utilized in both recessed and conventional sprinkler heads. Still further, DeGroot et al device is not capable of use in a recessed sprinkler head system where a portion of the sprinkler head is positioned in the ceiling. With such system it appears impossible to remove the pin after the cut-off device has been inserted, notwithstanding the friction problem previously discussed due to the confinement of the sprinkler head. It is, therefore, broadly an object of the present invention to provide a sprinkler head cut-off device which can be quickly and easily installed after the failure of a triggering device.

It is another object of the invention to provide a sprinkler head cut-off device which can be installed after the failure of a triggering device without having to shut down the entire sprinkler system.

It is yet another object of the invention to provide a sprinkler head cut-off device which after installation also serves as a substitute triggering device.

SUMMARY OF THE INVENTION

These and other objects of the invention are accomplished by providing a body member, composed of a meltable material and of a size allowing insertion in a sprinkler head, having a bore formed therein with a shoulder formed at one end and a second bore formed in a direction generally transverse to and in contact with the first bore at the end where the shoulder is formed, a piston having a central post with a radially extending plate fixed to one end and a groove formed in the other end positioned within the first bore and of sufficient length so that the groove may be aligned with the second bore, a resilient member fixed to the plate, a spring of sufficient compressive resistance to counteract the water pressure at the fire-sprinkler head, positioned so that one end rests against the body shoulder and the other end rests against the plate, the spring being of sufficient length so that when extended the resilient member is forced against the opening in the fire sprinkler head stopping the flow of water; and a retaining pin insertable into the second bore and capable of engaging the piston groove so that when the pin is so engaged, the spring is compressed and the piston is held motionless relative to the body member whereby transverse movement of the pin out of the groove releases the piston.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
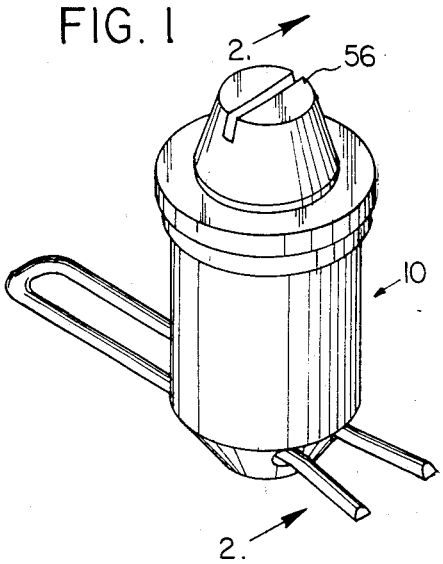
FIG. 1 is a perspective view of the present invention.
Figure 3:
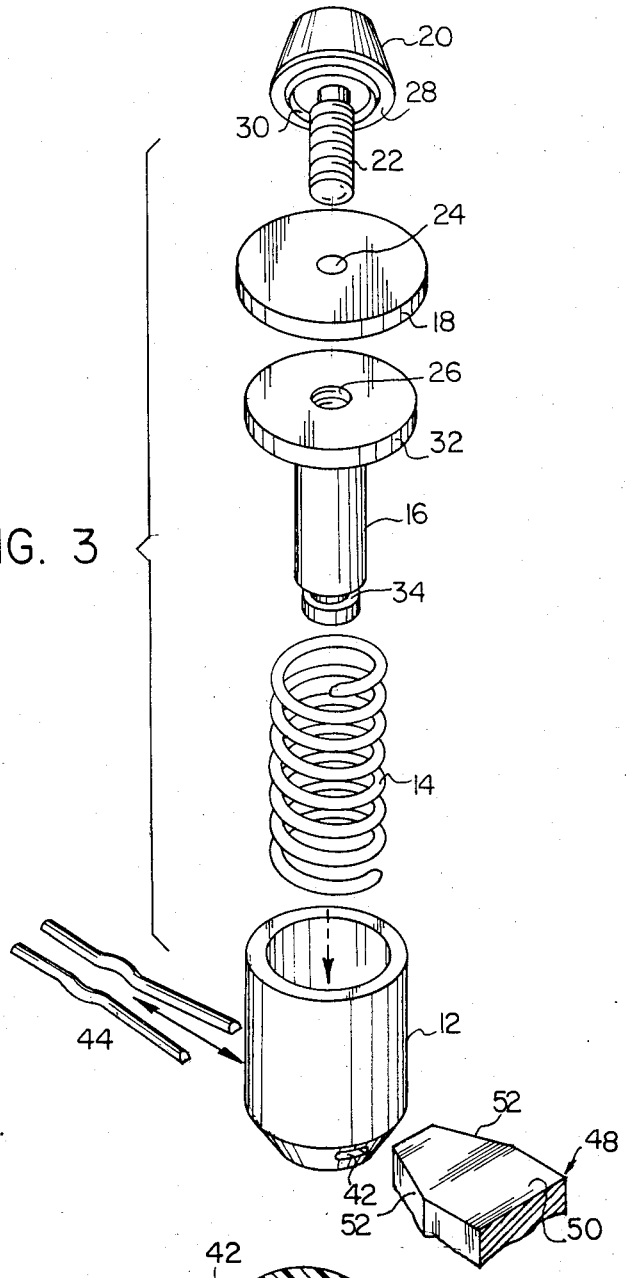
FIG. 3 is an exploded view of each of the components of the present invention and one end of the mounting tool.

The sprinkler system cut-off device according to the present invention is shown in FIG. 1 and generally designated as 10. Particularly with reference to FIGS. 1, 2 and 3, cut-off device 10 is shown to include a body portion 12, a spring 14, a piston 16, a sealing pad 18, and a centering member 20. In the preferred embodiment, body 12 is made from a meltable material such as a plastic having a melting point of 350° F. and wherein pad 18 is made from a resilient material such as rubber. Centering member 20 has a depending downwardly projecting threaded post 22 which passes through bore 24 in sealing pad 18 and screws into a suitably threaded bore 26 in piston 16. The under surface 28 of centering member 20 is shown to have a raised ring projection 30 extending downwardly therefrom. Projection 30 serves to create a positive seal between under surface 28 and sealing pad 18. Sealing pad 18 is shown to be pressed against plate 32 which is formed on one end of piston 16 and extends radially therefrom. The shaft portion of piston 16 is shown to extend through spring 14 and has a circumferential slot 34 formed at the shaft end opposite plate 32. Spring 14 is shown to rest against under surface 36 of plate 32 and against shoulder 38 formed in the hollow central bore 40 of body portion 12.

Figure 2:
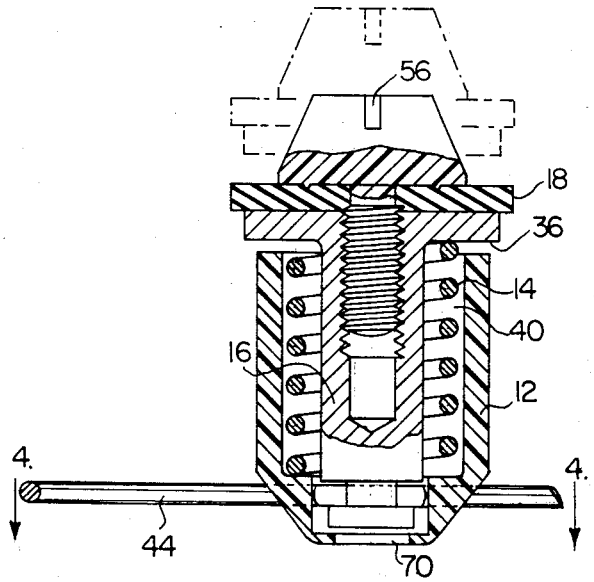
FIG. 2 is a sectional view taken along line 2—2 of FIG. 1.
Figure 4:
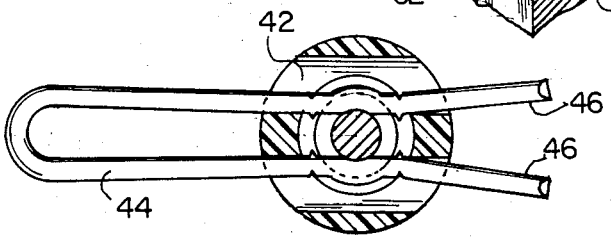
FIG. 4 is a sectional view taken along line 4—4 of FIG. 2.

As can be appreciated from FIG. 2, cut-off 10 is "armed" by assembling centering member 20 to piston 16, securing sealing pad 18 therebetween. Spring 14 is placed within bore 40 of body portion 12. The piston/-sealing pad/centering member assembly is then inserted axially through the center of spring 14 a sufficient distance such that slot 34 is aligned with bores 42 in the terminal end of body portion 12. The placement of U-shaped pin 44 in bores 42 such that each leg 46 engages a portion of slot 34 serves to hold piston 16, spring 14 and body portion 12 in a pretensioned relatively motionless position. By removing pin 44, spring 14 serves to extend piston 16 from body 12.

Figure 5:
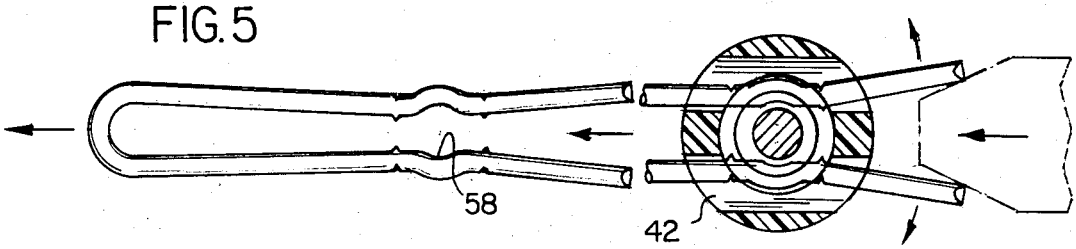
FIG. 5 is a sectional view similar to FIG. 4 showing the removal of the retaining pin.

Pin 44 is removed by spreading legs 46 a sufficient distance that they are outside groove 34, so that piston 16 can pass freely therebetween. To this end, a tool 48 is provided having an operative end 50 having tapered services 52. By passing operative end 50 between legs 46 in a fashion that the legs 46 are pressed against tapered services 52, movement of the tool results in transverse movement of legs 46 a sufficient distance to allow the release of piston 16, as shown in FIG. 5. Once piston 16 has been released, pin 44 can be removed with virtually no effort. It has been discovered that such transverse movement of legs 46 requires significantly less effort than that required to axially remove a single pin passing through bore 42 and through an aligned bore in piston 16.

Figure 7:
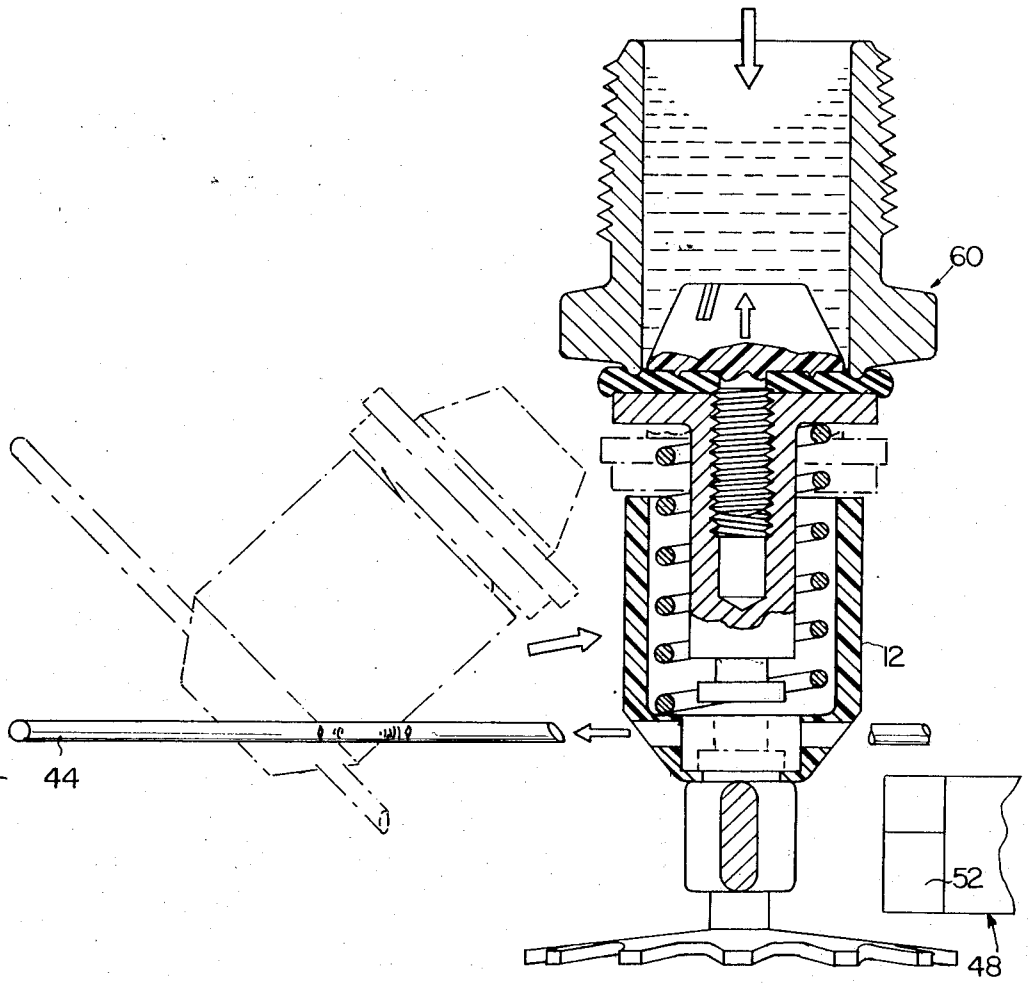
FIG. 7 is a sectional view taken along line 7—7 of FIG. 6, further including the present invention installed in the sprinkler head stopping the flow of water therefrom.

As shown in FIGS. 1 and 2, centering member 20 is provided with a frusto-conical outer surfaces 54 which, as shown in FIG. 7, is inserted into the sprinkler head opening. A notch 56 is provided in the member 20 to allow for the use of a tool, i.e. screw driver, to achieve a tight and secure engagement of sealing pad 18 between raised ring 30 and plate 32. It will also be noted that in the preferred embodiment legs 46 have been provided with an arcuate section 58 for the engagement of groove 34.

Figure 6:
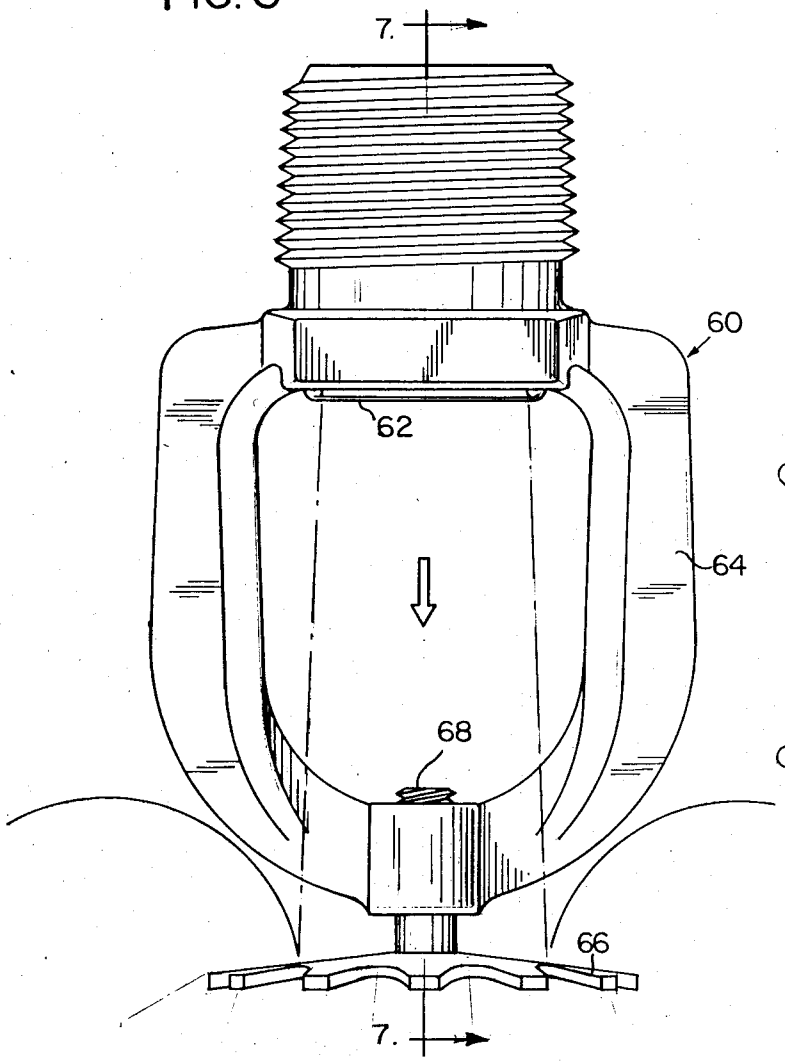
FIG. 6 is a side elevational view of a sprinkler head in which the triggering device has failed and been forced out allowing water to be freely dispensed.

Referring now to FIG. 6, a typical sprinkler head 60 is shown. The sprinkler head is seen to include an opening 62, a frame 64 to which is attached a disbursant plate 66. Plate 66 is attached to frame 64 by passing threaded post 68 through an appropriately threaded bore (not shown) in frame 64. It will be seen that threaded post 68 extends a short distance above frame 64. As shown in FIG. 7, cut-off 10 is placed in its armed condition within the confines of frame 64. An opening 70 is provided in the lower terminal end of body portion 12. Opening 70 is fixed over post 68 and serves to hold body portion 12 in position while legs 46 are moved transversely releasing piston 16. Legs 46 are spread by pulling tool 48 downward therebetween such that tapered surfaces 52 pass between and against legs 46. This is the preferred use of tool 48 over the direction shown in FIGS. 3 and 5. Upon release of piston 16, spring 14 serves to force centering member 20 into opening 62. In the preferred embodiment, the force and length of spring 16 is sufficient to create a water-tight seal between the edges of opening 62, sealing pad 18 and plate 32.

It should also be noted that by positioning bore 42 at that end of body 12 where shoulder 38 is formed, if cut-off device 10 is to be utilized in a recessed sprinkler-head system, pin 44 is nonetheless accessible for removal.

While a particular embodiment of the invention has been illustrated and described herein, it is not intended to limit the invention and changes and modifications may be made therein within the scope of the following claims. For example, pin 44 could be provided with an oversized loop at its closed end for securing the device during transverse movement of legs 46 to release piston 16. Such loop thereafter could provide ease in removal of the pin.

We claim:

1. An apparatus for stopping the flow of water through an opening in a fire-sprinkler head, said fire-sprinkler head being of the type having a support frame spaced about and downstream of said opening, comprising:

a body member, composed of a meltable material and of a size allowing insertion in a sprinkler head, having a first bore formed therein with a shoulder formed in said bore at one end thereof and at least one second bore formed therein in a direction generally transverse to said first bore and in contact with said first bore at the end wherein said shoulder is formed;

a piston having a central post with a radially extending plate fixed to one end of said post and at least one transverse slot formed in the other end of said post, said post having a portion positioned within said first bore and of sufficient length so that said at least one slot may be aligned with said at least one second bore;

a resilient member fixed to said plate, said resilient member being engageable with a periphery of said opening;

a spring of sufficient compressive resistance to counteract the pressure of said water flowing through said fire-sprinkler head, positioned so that one end thereof rests against said shoulder and the other end thereof rests against said plate, said spring being of sufficient length so that when extended said resilient member is forced against said opening in the fire sprinkler head stopping the flow of water therefrom; and a retaining pin capable of insertion in said at least one second bore and capable of engaging said at least one slot so that when said pin engages said at least one slot said spring is compressed and said piston is held motionless relative to said body member whereby transverse movement of said pin out of said at least one slot releases said piston, such that said apparatus is retained between the opening in the fire-sprinkler head and the support frame.

2. The apparatus of claim 1, wherein said body portion is comprised of a plastic material having a melting point of at least 350° F.

3. The apparatus of claim 1, wherein said post has slots on opposite sides of said post, said body member has second bores on opposite sides of said body member, said retaining pin comprises a U-shaped pin having legs disposed in said slots on either side of said post and wherein said second bores extend through said body member and wherein a portion of said legs extends beyond said body member.

4. The apparatus of claim 3, further comprising a release tool having oppositely tapered surfaces on one end thereof for passage between said pin legs, said second bores each being of considerably larger cross-section than said legs of said pin.

* * * * *